US011619438B2

(12) United States Patent
Allgeier et al.

(10) Patent No.: US 11,619,438 B2
(45) Date of Patent: Apr. 4, 2023

(54) TOGGLE HANDLE FOR AN APPLIANCE

(71) Applicant: Haier US Appliance Solutions, Inc., Wilmington, DE (US)

(72) Inventors: Brian Allgeier, Louisville, KY (US); Anthony Austin Cooper, La Grange, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/331,870

(22) Filed: May 27, 2021

(65) Prior Publication Data

US 2022/0381503 A1 Dec. 1, 2022

(51) Int. Cl.
*F25D 23/02* (2006.01)
*E05B 1/00* (2006.01)

(52) U.S. Cl.
CPC ..... *F25D 23/028* (2013.01); *E05B 1/0015* (2013.01); *E05Y 2900/31* (2013.01)

(58) Field of Classification Search
CPC ... F25D 23/028; E05B 1/0015; E05Y 2900/31
See application file for complete search history.

(56) References Cited

U.S. PATENT DOCUMENTS 4,819,802 A * 4/1989 Gutierrez ..... G11B 33/0455 221/87
9,366,471 B2 * 6/2016 Allen ..... F25D 23/028
2003/0106185 A1 * 6/2003 Worrell ..... E05B 1/0015 16/444
2004/0265082 A1 * 12/2004 Abrams ..... A61B 17/1617 408/226
2005/0066479 A1 * 3/2005 Kim ..... F25D 23/028 16/436
2006/0032023 A1 * 2/2006 Moon ..... E05B 1/0015 16/436
2006/0200948 A1 * 9/2006 Steurer ..... E05B 1/0015 16/412
2020/0217515 A1 7/2020 Bagawathkumar

FOREIGN PATENT DOCUMENTS

CN 109595864 A 4/2019
DE 102009002276 A1 10/2010
WO WO2019114192 A1 6/2019

* cited by examiner

*Primary Examiner* — James O Hansen
(74) *Attorney, Agent, or Firm* — Dority & Manning, P.A.

(57) ABSTRACT

A method for operating a refrigerator appliance includes operating a dispenser of the refrigerator appliance to initiate a flow of liquid water or ice into a container positioned within a dispensing recess of the dispenser in response to a user input at a user input panel of the refrigerator appliance, receiving one or more signals from a sensor positioned at the dispensing recess after operating the dispenser to initiate the flow of liquid water or ice into the dispensing recess, and detecting a presence of the container in the dispensing recess based at least in part on the one or more signals from the sensor only after operating the dispenser to initiate the flow of liquid water or ice into the dispensing recess. A related refrigerator appliance is also provided.

18 Claims, 6 Drawing Sheets

TOGGLE HANDLE FOR AN APPLIANCE

FIELD OF THE INVENTION

The present disclosure relates generally to toggle handles for appliances.

BACKGROUND OF THE INVENTION

Refrigerator appliance generally include a cabinet that defines one or more chambers for the receipt of food items for storage, and doors on the cabinet permit selective access to the chambers. To open a door, a user typically grabs and pulls a handle on the door. For various reasons, the handle may need to be removed from the door. For example, moving the refrigerator through a doorway can be difficult when the handle is mounted on the door. As another example, certain refrigerator appliances allow a customer to switch handles to a desired color and/or finish.

Known mechanisms used to mount handles to doors in refrigerator appliances can make removing the handle from the door problematic. Certain refrigerator appliances include a handle with a set screw that engages a mounting post on the door to secure the handle to the door. A customer trying to remove the handle can have difficulty locating the set screw and acquiring the correct tool to turn the set screw. Thus, removing handles from known refrigerator appliances can be a difficult and time-consuming process.

BRIEF DESCRIPTION OF THE INVENTION

The present subject matter provides an attachment assembly for an appliance handle. A slidable plunger may be toggled between an engaged position, in which the plunger locks onto a stud, and an unengaged position, in which the plunger is free of the stud. The plunger is disposed within an endcap. The endcap is configured to support and hold the plunger between the engaged and unengaged positions. The slidable plunger may be manually slidable between the engaged and unengaged positions. Thus, the attachment assembly may be toolless. Moreover, the attachment assembly may be easy for a user to interpret and actuate and/or may have a pleasant cosmetic appearance.

One example aspect of the present disclosure is directed to an appliance that includes a cabinet. A door is mounted to the cabinet. The door is configured for permitting selective access to the chamber of the cabinet. A pair of studs is positioned on the door. A handle assembly includes an elongated handle, a pair of end caps, and a pair of plungers. The elongated handle extends between a first end portion and a second end portion. Each of the first and second end portions of the elongated handle is received within a respective one of the pair of end caps. Each of the pair of plungers is slidably received within a respective one of the pair of end caps. Each of the pair of plungers is manually slidable relative to the respective one of the pair of end caps between an engaged configuration and a disengaged configuration. The pair of plungers interfere with the pair of studs on the door in the engaged configuration.

Another example aspect of the present disclosure is directed to a handle assembly for an appliance that includes a pair of studs, an elongated handle, a pair of end caps, and a pair of plungers. The elongated handle extends between a first end portion and a second end portion. Each of the first and second end portions of the elongated handle is received within a respective one of the pair of end caps. Each of the pair of plungers is slidably received within a respective one of the pair of end caps. Each of the pair of plungers is manually slidable relative to the respective one of the pair of end caps between an engaged configuration and a disengaged configuration. The pair of plungers interfere with the pair of studs in the engaged configuration.

Variations and modifications may be made to these example embodiments of the present disclosure. These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
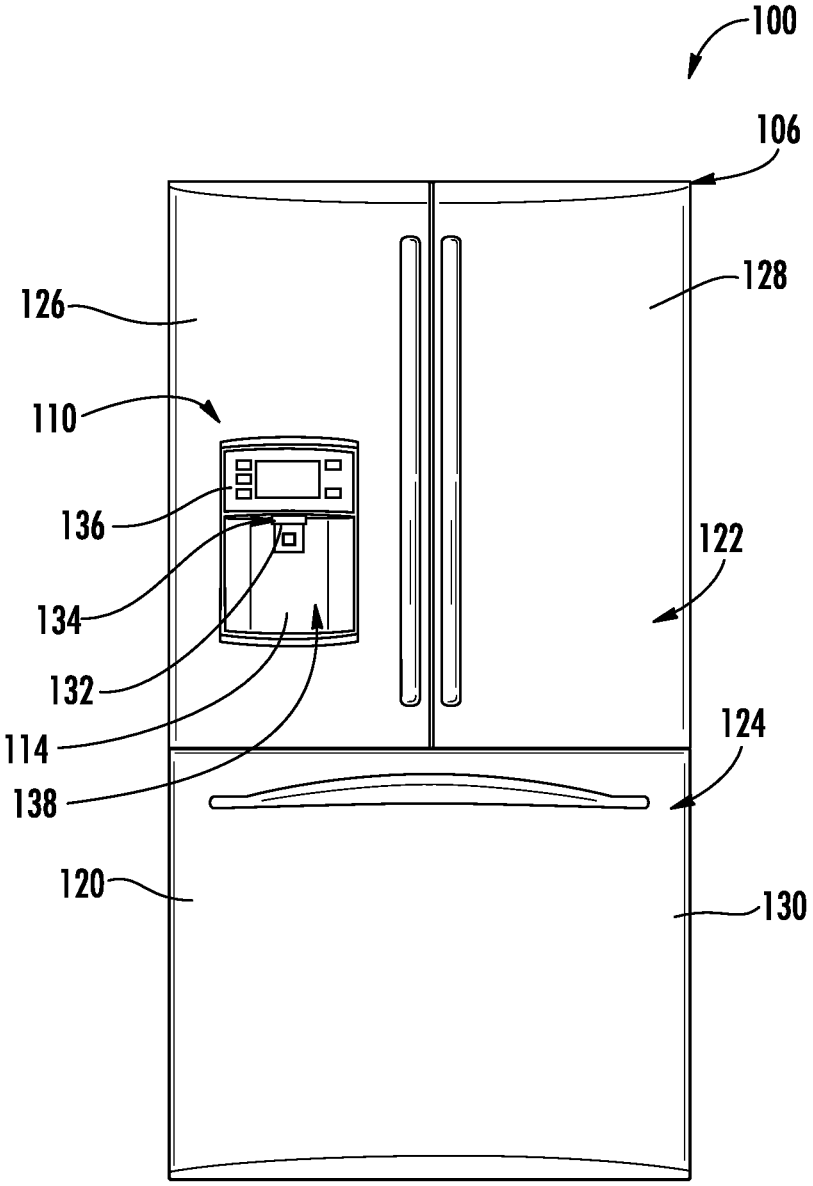
FIG. 1 is a front, elevation view of a refrigerator appliance according to an example embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations may be made in the present invention without departing from the scope or spirit of the invention. For instance, features illustrated or described as part of one embodiment may be used with another embodiment to yield a still further embodiment. Thus, it is intended that the present invention covers such modifications and variations as come within the scope of the appended claims and their equivalents.

As used herein, the terms “includes” and “including” are intended to be inclusive in a manner similar to the term “comprising.” Similarly, the term “or” is generally intended to be inclusive (i.e., "A or B" is intended to mean "A or B or both"). Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a ten percent (10%) margin.

Example aspects of the present disclosure are directed to a handle assembly for an appliance. The handle assembly includes an elongated handle, a pair of end caps, and a pair of plungers. Each of the end caps may be positioned on a respective end of the elongated handle, and the plungers may be slidably disposed within the end caps. The slidable plungers may be toggled between an engaged position, in which the plungers lock onto studs, and an unengaged position, in which the plungers are free of the studs. The endcaps are configured to support and hold the plungers between the engaged and unengaged positions. A user may manually slide the plungers between the engaged and unengaged positions. Thus, the removing and mounting the handle assembly to an associated appliance may be toolless. Moreover, the handle assembly may be easy for a user to interpret how to operate and/or may have a pleasant cosmetic appearance.

Referring now to the figures, FIG. 1 depicts a front view of an example embodiment of a refrigerator appliance 100. Refrigerator appliance 100 includes a cabinet or housing 120 defining an upper fresh food chamber 122 and a lower freezer chamber 124 arranged below the fresh food chamber 122. As such, refrigerator appliance 100 is generally referred to as a bottom-mount refrigerator appliance. In the exemplary embodiment, housing 120 also defines a mechanical compartment (not shown) for receipt of a sealed cooling system. Using the teachings disclosed herein, one of skill in the art will understand that the present invention may be used with other types of refrigerator appliances (e.g., side-by-sides or top-mounts). Consequently, the description set forth herein is for illustrative purposes only and is not intended to limit the invention to any particular style of refrigerator appliance or arrangement of chilled chambers.

Refrigerator doors 126, 128 are rotatably hinged to an edge of housing 120 for accessing fresh food compartment 122. A freezer door 130 is arranged below refrigerator doors 126, 128 for accessing freezer chamber 124. In the exemplary embodiment, freezer door 130 is coupled to a freezer drawer (not shown) slidably mounted within freezer chamber 124.

Refrigerator appliance 100 includes a dispensing assembly 110 for dispensing liquid water and ice. Dispensing assembly 110 includes a dispenser 114 positioned on an exterior portion of refrigerator appliance 100. Dispenser 114 includes a discharging outlet 134 for accessing ice and liquid water. Dispensing assembly 110 further includes a sensor 112 positioned on discharging outlet 134. As will be described in more detail below, sensor 112 may be configured to detect a presence of a container positioned within dispensing assembly 110, and to detect the top lip of the container. A user interface panel 136 is provided for controlling the mode of operation. For example, user interface panel 136 includes a water dispensing button (not labeled) and an ice-dispensing button (not labeled) for selecting a desired mode of operation such as crushed, non-crushed ice, or liquid water, etc.

Discharging outlet 134 is an external part of dispenser 114, and is mounted in a dispensing recess or recessed portion 138 defined in an outside surface of refrigerator door 126. Recessed portion 138 is positioned at a predetermined elevation convenient for a user to access ice or liquid water and enabling the user to access ice or liquid water without the need to bend-over and without the need to access freezer chamber 124. In the exemplary embodiment, recessed portion 138 is positioned at a level that approximates the chest level of a user.

Operation of the refrigerator appliance 100 is regulated by a controller (not shown) that is operatively coupled to user interface panel 136 and/or sensor 112. Panel 136 provides selections for user manipulation of the operation of refrigerator appliance 100 such as e.g., selections between whole or crushed ice, chilled liquid water, and/or other options. In response to user manipulation of the user interface panel 136, the controller operates various components of the refrigerator appliance 100. The controller may be positioned in a variety of locations throughout refrigerator appliance 100. In the illustrated embodiment shown in FIG. 1, the controller is located within beneath the user interface panel 136 on door 126. In such an embodiment, input/output ("I/O") signals may be routed between controller and various operational components of refrigerator appliance 100. In one exemplary embodiment, the user interface panel 136 may represent a general purpose I/O ("GPIO") device or functional block. In another exemplary embodiment, the user interface 136 may include input components, such as one or more of a variety of electrical, mechanical or electromechanical input devices including rotary dials, push buttons, and touch pads. The user interface 136 may be in communication with the controller via one or more signal lines or shared communication busses.

Figure 2:
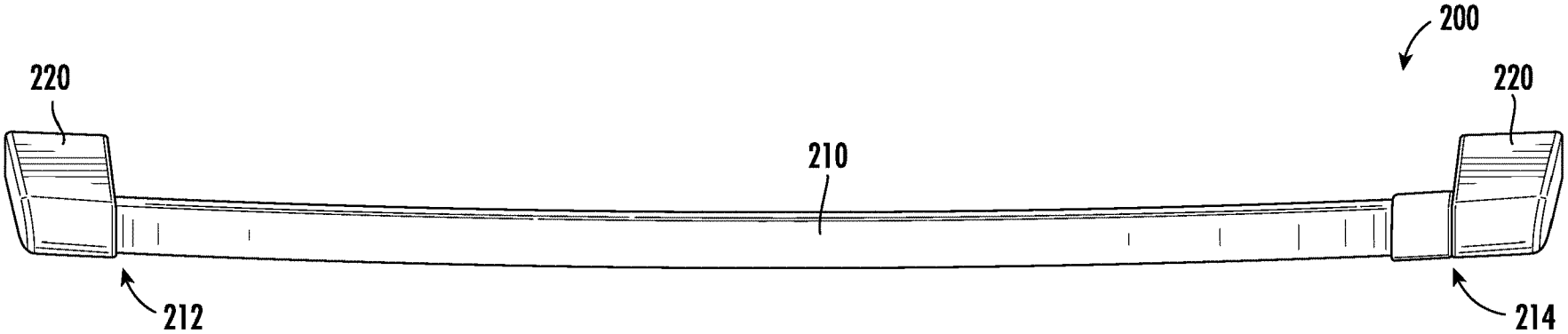
FIG. 2 is a perspective view of a handle assembly for an appliance according to an example embodiment of the present disclosure.
Figure 3:
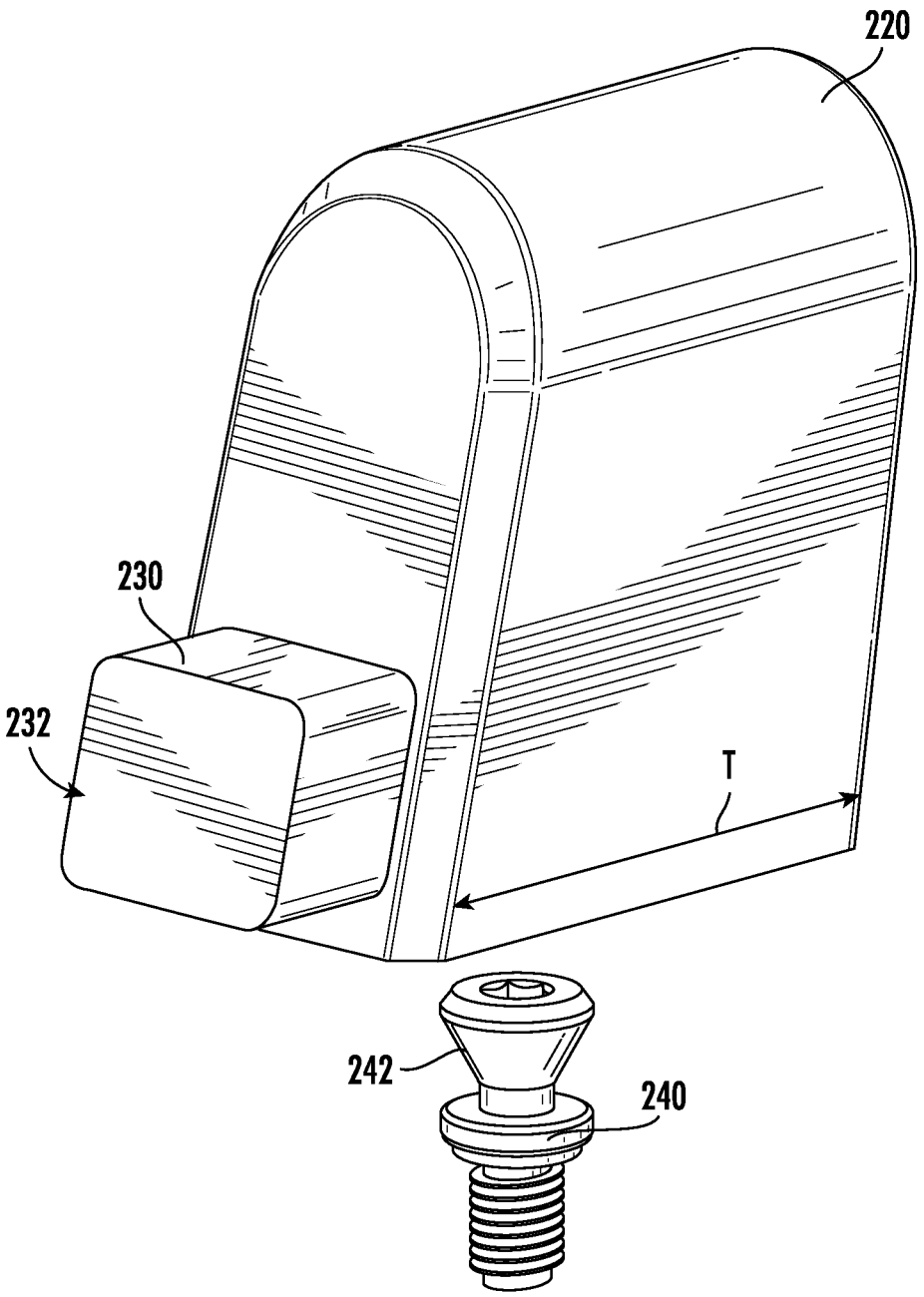
FIG. 3 is a perspective view of a stud, an end cap, and a plunger of the example handle assembly of FIG. 2.
Figure 4:
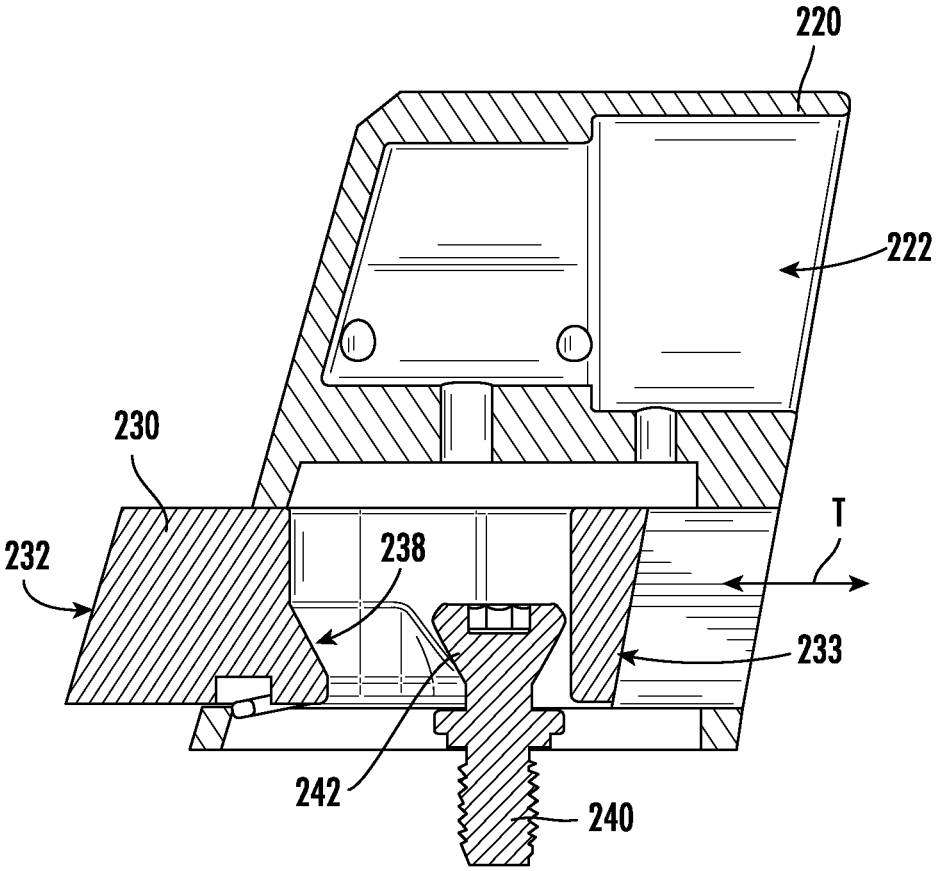
FIG. 4 is a section view of the stud, end cap, and plunger of the example handle assembly of FIG. 2 with the plunger shown in an unengaged position.

FIGS. 2 through 4 illustrate a handle assembly 200 for an appliance according to an example embodiment of the present disclosure. Handle assembly 200 may be used with refrigerator appliance 100 on one or more of refrigerator doors 126, 128 and freezer door 130. Thus, handle assembly 200 is described in greater detail below in the context of refrigerator appliance 100. However, it will be understood that handle assembly 200 may be used on or with any suitable appliance in alternative example embodiments, e.g., on a dishwasher appliance, a dryer appliance, a washing machine appliance, an oven appliance, etc.

With reference to FIG. 2, handle assembly 200 includes an elongated handle 210 and a pair of end caps 220. Elongated handle 210 may extend longitudinally between a first end portion 212 and a second end portion 214. A user may grasp and pull elongated handle 210 between end caps 220 to open an associated door. Elongated handle 210 may be tubular and may be constructed of a suitable material, such as stainless steel, enamel-coated steel, or matte-finished steel. Elongated handle 210 may be available in various designs, configurations, finishes, etc., and a user may switch elongated handle 210 for a desired appearance.

A length of elongated handle 210 between first and second end portions 212, 214 may be selected depending upon an intended appliance installation. For example, the length of elongated handle 210 between first and second end portions 212, 214 may be no less than fifteen centimeters (15 cm) and no more than one hundred and fifty centimeters (150 cm). Elongated handle 210 may be mounted to refrigerator appliance 100 with end caps 220. For instance, each of first and second end portions 212, 214 of elongated handle 210 may be received within a respective one of end caps 220, and end caps 220 may be mounted to refrigerator appliance 100, as discussed in greater detail below.

Figure 6:
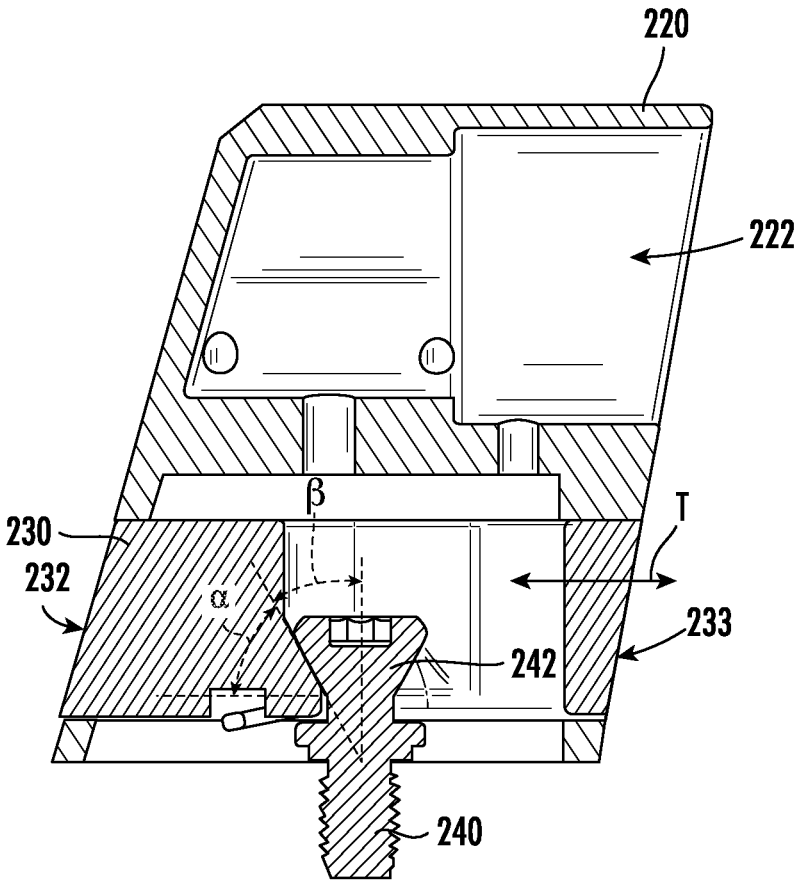
FIG. 6 is a section view of the stud, end cap, and plunger of the example handle assembly of FIG. 2 with the plunger shown in an engaged position.
Figure 7:
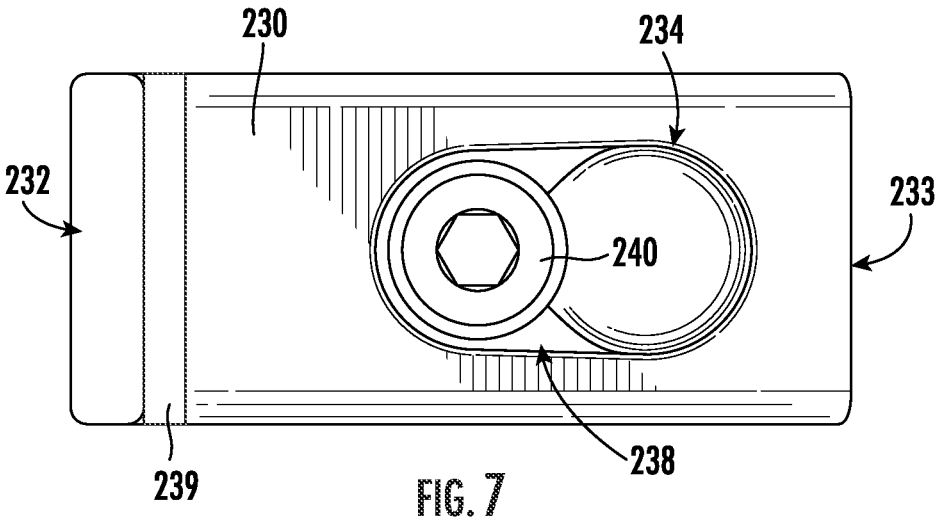
FIG. 7 is a plan view of the stud and plunger of the example handle assembly of FIG. 2 with the plunger shown in the engaged position.

Turning now to FIGS. 3, 4, and 6, one of end caps 220 from FIG. 2 is shown. While only one of end caps 220, plungers 230, and studs 240 is shown in FIGS. 3, 4, and 6, it will be understood that the other of end caps 220, plungers 230, and studs 240 may be constructed in the same or similar manner to that described below for the one of end caps 220, plungers 230, and studs 240 shown in FIGS. 3, 4, and 6. Thus, the other of end caps 220, plungers 230, and studs 240 may include the same components described below for the one of end caps 220, plungers 230, and studs 240 shown in FIGS. 3, 4, and 6.

As shown, each of end caps 220 may define a recess 222, and each of first and second end portions 212, 214 of elongated handle 210 may be received within the recess 222 of the respective one of end caps 220. Thus, to mount elongated handle 210 to end caps 220, a user may insert first and second end portions 212, 214 of elongated handle 210 into the recess 222 of the respective one of end caps 220. Within recess 222, interference between elongated handle 210 and end caps 220 may prevent rotation of elongated handle 210 relative to end caps 220. Thus, e.g., projections 224 or other features within recess 222 may engage slots or other features of elongated handle 210 to block relative rotation between elongated handle 210 and end caps 220. End caps 220 may be constructed of a suitable material, such as molded plastic, cast metal, etc. End caps 220 may be available in various designs, configurations, finishes, etc., and a user may switch end caps 220 for a desired appearance.

With reference to FIGS. 3 through 7, handle assembly 200 also includes a pair of plungers 230 and a pair of studs 240. Each of plungers 230 is slidably received within a respective one of end caps 220. Studs 240 may be mounted to refrigerator appliance 100, e.g., one or doors 126, 128, 130. For example, studs 240 may be threaded, fastened, welded, adhered, etc. to one or doors 126, 128, 130. Plungers 230 may selectively engage studs 240 to mount end caps 220 to refrigerator appliance 100.

Figure 5:
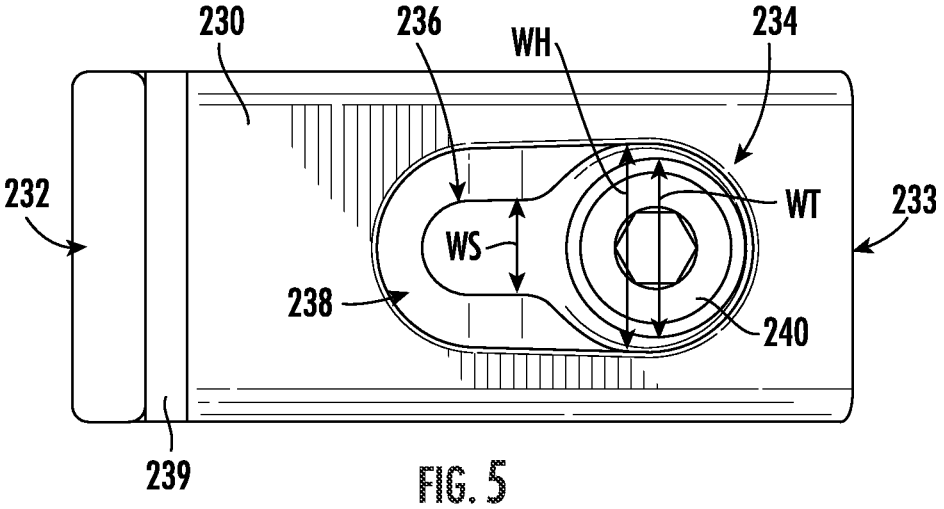
FIG. 5 is a plan view of the stud and plunger of the example handle assembly of FIG. 2 with the plunger shown in the unengaged position.

Plungers 230 are manually slidable relative to end caps 220, e.g., along a direction of travel T, between an engaged configuration and a disengaged configuration. In FIGS. 4 and 5, plunger 230 is shown in the disengaged configuration. Conversely, plunger 230 is shown in the engaged configuration in FIGS. 6 and 7. A user may shift plungers 230 between the engaged and disengaged configurations by pushing on end faces 232, 233 of plunger 230. Thus, shifting plungers 230 between the engaged and disengaged configurations may advantageously be toolless and performed quickly.

As shown in FIGS. 4 through 7, plunger 230 defines a hole 234 and a slot 236. Hole 234 is positioned such that stud 240 is positioned at and/or aligned with hole 234 in the disengaged configuration. A width WH of hole 234 may be sized such that the width WH of hole 234 is greater than a width WT of stud 240. Thus, stud 240 may be inserted and pass through hole 234 in the disengaged configuration. Moreover, a user may install end cap 220 over stud 240 by inserting stud 240 through hole 234 when plunger 230 is in the disengaged configuration.

Slot 236 is positioned such that stud 240 is positioned at and/or aligned with slot 236 in the engaged configuration. A width WS of slot 236 (e.g., perpendicular to the direction of movement for plunger 230 between the engaged and disengaged configurations) may be sized such that the width WS of slot 236 is less than the width WT of stud 240. Thus, stud 240 may interfere with plunger 230 at slot 236 in the engaged configuration.

Slot 236 may be positioned contiguous with hole 234. Thus, stud 240 may move between hole 234 and slot 236 as plunger 230 slides between the engaged and disengaged configurations. Moreover, from the arrangement shown in FIGS. 4 and 5, a user may push on a first end face 232 of plunger 230 to shift plunger 230 from the disengaged configuration to the engaged configuration shown in FIGS. 6 and 7 such that stud 240 moves from hole 234 into slot 236. Conversely, from the arrangement shown in FIGS. 6 and 7, a user may push on a second end face 233 of plunger 230 to shift plunger 230 from the engaged configuration to the disengaged configuration shown in FIGS. 4 and 5 such that stud 240 moves from slot 236 into hole 234. As may be seen from the above, to install end caps 220 on studs 240, a user places endcaps 220 over studs 240 and then pushes plungers 230 towards each other until plungers 230 are firmly seated on studs 240. Conversely, to remove end caps 220 from studs 240, the user pushes plungers 230 away from each other until plungers 230 are free of studs 240. First and second end faces 232, 233 of plunger 230 may be sized to facilitate manual actuation by a user. For example, first end face 232 and/or second end face 233 of plunger 230 may have a surface area no less than three centimeters squared (3 $cm^2$), e.g., and no more than twenty centimeters squared (20 $cm^2$). Such sizing may advantageously facilitate manual actuation of plunger 230.

Plunger 230 may define a U-shaped engagement surface 238 at slot 236. U-shaped engagement surface 238 may be tapered at an angle $\alpha$ with respect to a plane of slot 236 (e.g., that is perpendicular to a central axis of stud 240). Thus, e.g., U-shaped engagement surface 238 may be tapered at an angle $\beta$ with respect to the central axis of stud 240. In certain example embodiments, the angle $\alpha$ may be no greater than forty-five degrees (45°). Such angling of the U-shaped engagement surface 238 (in combination with a corresponding angling of the stud 240) may facilitate engagement of the plunger 230 with stud 240 and assist with holding plunger 230 in the engaged configuration. For instance, such angling of the U-shaped engagement surface 238 may generate sufficient static friction between plunger 230 with stud 240 to hold plunger 230 in the engaged configuration. Stud 240 may include a frustoconical body 242 that is seated on U-shaped engagement surface 238 in the engaging configuration. Frustoconical body 242 may be shaped to complement U-shaped engagement surface 238. For example, an angle of frustoconical body 242 may be selected to complement U-shaped engagement surface 238. In addition, the materials selected for plunger 230 and stud 240 may facilitate engagement of the plunger 230 with stud 240 and assist with holding plunger 230 in the engaged configuration. For example, stud 240 may be a metal stud, plunger 240 may be a plastic plunger. The plastic material of plunger 230 may allow wedging of plunger 230 under stud 240 (e.g., such U-shaped engagement surface 238 deforms under frustoconical body 242) to tightly lock plunger 230 relative to stud 240 and prevent movement of plunger 230 away from the engaged configuration.

As described in greater detail below, handle assembly 200 includes features that reduce accidental removal of handle assembly 200 from an associated appliance. For example, with handle assembly 200 installed on freezer door 130 of refrigerator appliance 100, a user may push both plungers 230 outwardly at second end faces 233 of plungers 230.

Second end faces 233 of plungers 230 may be positioned at an interior portion of handle assembly 200 behind belonged handle 210 and may face each other the space between end caps 220. Such positioning of second end faces 233 may advantageously reduce accidental actuation of plungers 230 from the engaged configuration because second end faces 233 are located remote from natural user touchpoint locations and thus unlikely to be touched accidentally. As another example, both plungers 230 (not just one) must be actuated to the unengaged configuration to remove handle assembly 200 from refrigerator appliance 100. Thus, even if one of plungers 230 becomes loose and moves away from the engaged configuration, handle assembly 200 will not detach from freezer door 130, although handle assembly 200 may noticeably loosen. Moreover, due to plunger 230 being wedged under 240, moving plunger 230 away from the engaged configuration can require a focused push of significant magnitude that is unlikely to result from an accidental brush or nudge. Plungers 230 may also include a band 239 below first end face 232. Band 239 may have a color different from first end face 232, such as a highly visible red. Band 239 may be disposed within end cap 220 when plunger 230 is in the engaged configuration. Thus, band 239 may be hidden and not visible within end cap 220 when plunger 230 is in the engaged configuration. Conversely, band 239 may be disposed outside of end cap 220 when plunger 230 is positioned away from the engaged configuration. Thus, band 239 may be visible when plunger 230 is not in the engaged configuration. Thus, when visible, band 239 may alert a user that plunger 230 has shifted away from the engaged configuration.

Figure 8:
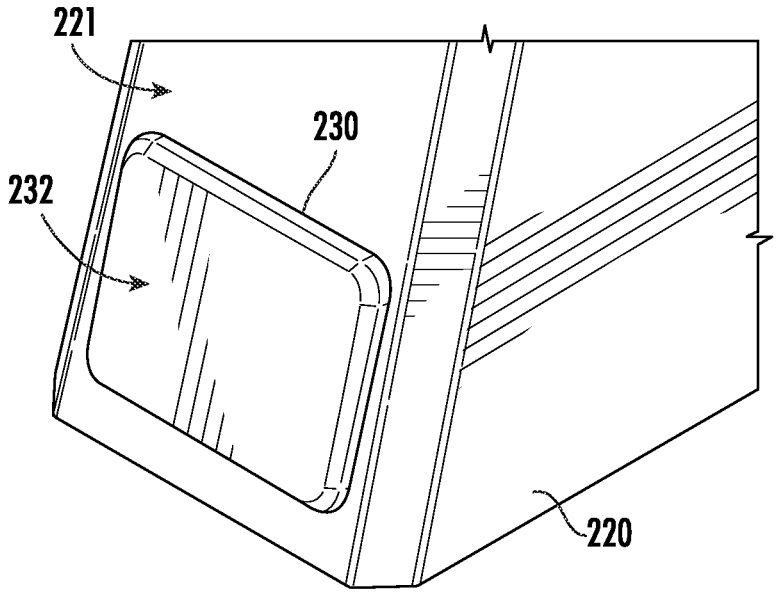
FIG. 8 is a partial perspective views of an end cap and a plunger according to another example embodiment of the present disclosure.
Figure 9:
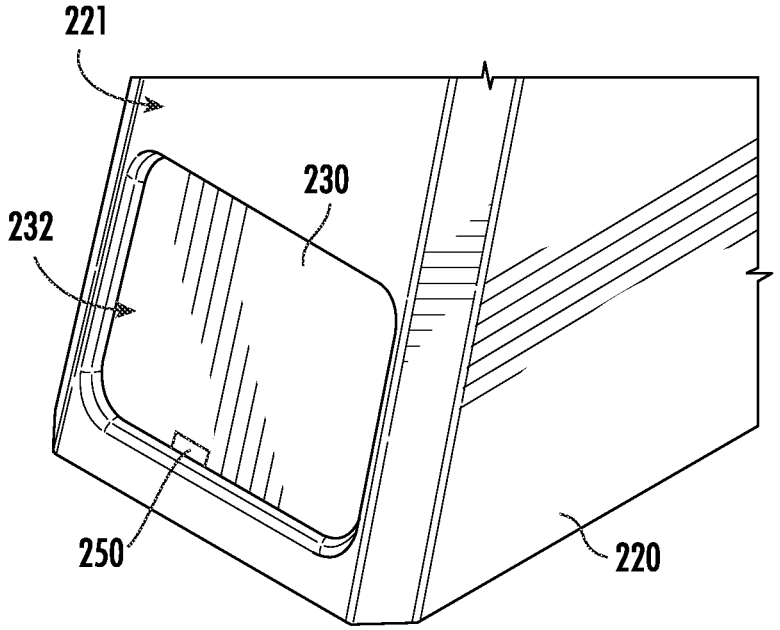
FIG. 9 is a partial perspective views of an end cap and a plunger according to yet another example embodiment of the present disclosure.

In the example embodiment shown in FIGS. 2 through 7, first end face 232 of plunger 230 is positioned flush with an outer surface 221 of end cap 220 when plunger 230 is in the engaged configuration. FIGS. 8 and 9 are partial perspective views of end cap 220 and plunger 230 according to alternative example embodiments. In FIG. 8, first end face 232 of plunger 230 is positioned proud of outer surface 221 of end cap 220 when plunger 230 is in the engaged configuration. Conversely, first end face 232 of plunger 230 is positioned sunken to outer surface 221 of end cap 220 when plunger 230 is in the engaged configuration as shown in FIG. 9.

As shown in FIG. 9, end cap 220 and/or plunger 230 may include a snap lock 250, e.g., at second end face 233 of plunger 230. Snap lock 250 couples and positively locks plunger 230 to end cap 220 in the engaged configuration. Thus, to shift plunger away from the engaged configuration, a user may press or otherwise actuate snap lock 250 prior to pushing on second end face 233.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An appliance, comprising:

a cabinet;

a door mounted to the cabinet, the door configured for permitting selective access to a chamber of the cabinet;

a pair of studs positioned on the door; and a handle assembly comprising an elongated handle extending between a first end portion and a second end portion, a pair of end caps, each of the first and second end portions of the elongated handle received within a respective one of the pair of end caps, and a pair of plungers, each of the pair of plungers slidably received within a respective one of the pair of end caps, wherein each of the pair of plungers is manually slidable relative to the respective one of the pair of end caps between an engaged configuration and a disengaged configuration, the pair of plungers interfering with the pair of studs on the door in the engaged configuration, and wherein a first one of the pair of plungers defines a hole and a slot, the hole positioned such that a first one of the pair of studs is positioned at the hole in the disengaged configuration, a width of the hole sized such that the width of the hole is greater than a width of the first one of the pair of studs, the slot positioned such that the first one of the pair of studs is positioned at the slot in the engaged configuration, the slot positioned contiguous with the hole, a width of the slot sized such that the width of the slot is less than the width of the first one of the pair of studs.

2. The appliance of claim 1, wherein the first one of the pair of plungers defines a U-shaped engagement surface at the slot, the U-shaped engagement surface tapered at an angle with respect to a plane of the slot, and the angle is no greater than forty-five degrees.

3. The appliance of claim 2, wherein the first one of the pair of studs comprises a frustoconical body seated on the U-shaped engagement surface in the engaging configuration.

4. The appliance of claim 3, wherein the first one of the pair of studs is a metal stud, and the first one of the pair of plungers is a plastic plunger.

5. The appliance of claim 1, wherein a second one of the pair of plungers defines a hole and a slot, the hole of the second one of the pair of plungers positioned such that a second one of the pair of studs is positioned at the hole of the second one of the pair of plungers in the disengaged configuration, a width of the hole of the second one of the pair of plungers sized such that the width of the hole of the second one of the pair of plungers is greater than a width of the second one of the pair of studs, the slot of the second one of the pair of plungers positioned such that the second one of the pair of studs is positioned at the slot of the second one of the pair of plungers in the engaged configuration, the slot of the second one of the pair of plungers positioned contiguous with the hole of the second one of the pair of plungers, a width of the slot of the second one of the pair of plungers sized such that the width of the slot of the second one of the pair of plungers is less than the width of the second one of the pair of studs.

6. The appliance of claim 1, wherein an end face of a first one of the pair of plungers is positioned proximate an outer surface of a first one of the pair of end caps in the engaged configuration, an end face of a second one of the pair of plungers is positioned proximate an outer surface of a second one of the pair of end caps in the engaged configuration, and the end face of the first one of the pair of plungers faces the end face of the second one of the pair of plungers.

7. The appliance of claim 1, wherein an end face of a first one of the pair of plungers is positioned proximate an outer surface of a first one of the pair of end caps in the engaged configuration, and a surface area of the end face of a first one of the pair of plungers is no less than three centimeters squared.

8. The appliance of claim 1, wherein an end face of a first one of the pair of plungers is positioned flush with an outer surface of a first one of the pair of end caps in the engaged configuration.

9. The appliance of claim 1, wherein an end face of a first one of the pair of plungers is a first color, and a portion of the first one of the pair of plungers directly below the end face is a second, different color.

10. A handle assembly for an appliance, comprising:

a pair of studs;

an elongated handle extending between a first end portion and a second end portion;

a pair of end caps, each of the first and second end portions of the elongated handle received within a respective one of the pair of end caps; and a pair of plungers, each of the pair of plungers slidably received within a respective one of the pair of end caps, wherein each of the pair of plungers is manually slidable relative to the respective one of the pair of end caps between an engaged configuration and a disengaged configuration, the pair of plungers interfering with the pair of studs in the engaged configuration, and wherein a first one of the pair of plungers defines a hole and a slot, the hole positioned such that a first one of the pair of studs is positioned at the hole in the disengaged configuration, a width of the hole sized such that the width of the hole is greater than a width of the first one of the pair of studs, the slot positioned such that the first one of the pair of studs is positioned at the slot in the engaged configuration, the slot positioned contiguous with the hole, a width of the slot sized such that the width of the slot is less than the width of the first one of the pair of studs.

11. The handle assembly of claim 10, wherein the first one of the pair of plungers defines a U-shaped engagement surface at the slot, the U-shaped engagement surface tapered at an angle with respect to a plane of the slot, and the angle is no greater than forty-five degrees.

12. The handle assembly of claim 11, wherein the first one of the pair of studs comprises a frustoconical body seated on the U-shaped engagement surface in the engaging configuration.

13. The handle assembly of claim 12, wherein the first one of the pair of studs is a metal stud, and the first one of the pair of plungers is a plastic plunger.

14. The handle assembly of claim 10, wherein a second one of the pair of plungers defines a hole and a slot, the hole of the second one of the pair of plungers positioned such that a second one of the pair of studs is positioned at the hole of the second one of the pair of plungers in the disengaged configuration, a width of the hole of the second one of the pair of plungers sized such that the width of the hole of the second one of the pair of plungers is greater than a width of the second one of the pair of studs, the slot of the second one of the pair of plungers positioned such that the second one of the pair of studs is positioned at the slot of the second one of the pair of plungers in the engaged configuration, the slot of the second one of the pair of plungers positioned contiguous with the hole of the second one of the pair of plungers, a width of the slot of the second one of the pair of plungers sized such that the width of the slot of the second one of the pair of plungers is less than the width of the second one of the pair of studs.

15. The handle assembly of claim 10, wherein an end face of a first one of the pair of plungers is positioned proximate an outer surface of a first one of the pair of end caps in the engaged configuration, an end face of a second one of the pair of plungers is positioned proximate an outer surface of a second one of the pair of end caps in the engaged configuration, and the end face of the first one of the pair of plungers faces the end face of the second one of the pair of plungers.

16. The handle assembly of claim 10, wherein an end face of a first one of the pair of plungers is positioned proximate an outer surface of a first one of the pair of end caps in the engaged configuration, and a surface area of the end face of a first one of the pair of plungers is no less than three centimeters squared.

17. The handle assembly of claim 10, wherein an end face of a first one of the pair of plungers is positioned flush with an outer surface of a first one of the pair of end caps in the engaged configuration.

18. The handle assembly of claim 10, wherein an end face of a first one of the pair of plungers is a first color, and a portion of the first one of the pair of plungers directly below the end face is a second, different color.

* * * * *